US010792221B2

(12) United States Patent
Hogan

(10) Patent No.: US 10,792,221 B2
(45) Date of Patent: Oct. 6, 2020

(54) DISPENSING CONTAINERS

(71) Applicant: MEDI-Clear Ltd, Hull (GB)

(72) Inventor: Mark Paul Hogan, Hull (GB)

(73) Assignee: MEDI-Clear Ltd, Hull (GB)

( * ) Notice: Subject to any disclaimer, the term of this patent is extended or adjusted under 35 U.S.C. 154(b) by 52 days.

(21) Appl. No.: 16/181,768

(22) Filed: Nov. 6, 2018

(65) Prior Publication Data

US 2019/0151197 A1 May 23, 2019

(30) Foreign Application Priority Data

Nov. 21, 2017 (GB) ..... 1719304.6

(51) Int. Cl.
*A61J 1/03* (2006.01)
*B65D 75/32* (2006.01)
*B65D 83/04* (2006.01)

(52) U.S. Cl.
CPC ..... *A61J 1/035* (2013.01); *B65D 75/327* (2013.01); *B65D 83/0445* (2013.01)

(58) Field of Classification Search
CPC ..... A61J 1/035; A61J 1/03; B65D 75/327; B65D 83/0445
USPC ..... 206/531, 264, 532, 538, 484, 484.2; 229/87.05
See application file for complete search history.

(56) References Cited

U.S. PATENT DOCUMENTS 6,164,444 A * 12/2000 Bray ..... B65D 75/5838 206/268
7,624,872 B2 * 12/2009 Elliott ..... A61J 1/03 206/484.2
8,783,454 B2 * 7/2014 Igo ..... B65D 75/5838 206/242
2015/0041356 A1 * 2/2015 Glaude ..... A61J 1/035 206/532

(Continued)

FOREIGN PATENT DOCUMENTS

DE 2003613676 T 9/2003
DE 102008016033 A1 10/2009
WO 2012049447 A1 4/2012

OTHER PUBLICATIONS

Combined Search and Examination Report for Great Britain Application No. GB1719304.6, published by the United Kingdom Intellectual Property Office, dated May 1, 2018, 7 pages.

*Primary Examiner* — Rafael A Ortiz
(74) *Attorney, Agent, or Firm* — Kilyk & Bowersox, P.L.L.C.

(57) ABSTRACT

A container for storing consumer products is described. The container includes a tray having a generally planar top surface into which has been formed one or more discrete cavities. A seal includes a cover film secured to the top surface of the tray to seal the one or more cavities. The cover film has pre-formed lines of separation defining a releasable portion per cavity, and a barrier patch per releasable portion secured to the cover film. Each releasable portion is attached to the remainder of the cover film by a bridge region defined (Continued)

by a gap in the associated pre-formed line of separation. Each barrier patch includes a main portion that is shaped and sized so that in use it overlies an associated cavity, and a securing portion that projects outwardly from the main portion and which is substantially aligned with the bridge region of the associated releasable portion.

19 Claims, 8 Drawing Sheets

(56) References Cited

U.S. PATENT DOCUMENTS

2015/0374033 A1* 12/2015 Pilzecker ..... B65D 85/1018
206/264
2016/0096678 A1* 4/2016 Tacchi ..... B65D 5/548
206/264

* cited by examiner

PRICE ART

DISPENSING CONTAINERS

CROSS-REFERENCE TO RELATED APPLICATION

The present application claims priority to Great Britain Patent Application No. 1719304.6 filed on Nov. 21, 2017, the disclosure of which is expressly incorporated by reference herein in its entirety.

FIELD OF THE INVENTION

The invention relates to containers for storing and dispensing consumer products. The term consumer products is intended to cover a wide variety of products as illustrated by the following (non-exhaustive) list: foods, either for immediate consumption, pre-cooked, prepared or oven ready, including prepared meals, confectionary, hardware and DIY items, cosmetics, seeds, animal and fish feeds, electronic components, medical appliances and dressings, medicines and medication such as pills, tablets and capsules.

The containers may be used in place of conventional blister packs for the packaging of pills, tablets and capsules, or may be used for organising and storing mixed medication for subsequent dispensation according to a predefined dosage regimen. The principle behind such mixed medication containers is that a dosage regimen of mixed medication can be organised in advance for a period of a week or more, and a patient or nurse can then remove from the container, at predefined times over the said period, the one or more pills, tablets and/or capsules to be administered on each occasion according to the dosage regimen.

BACKGROUND TO THE INVENTION

Blister packs are of course well known for the storage and dispensing of pills, tablets and capsules, which are stored individually in cavities in a multi-cavity tray and removed by pushing each pill, tablet or capsule through a rupturable film or foil covering the cavities. The film or foil cover may be paper or a plastics film that can be peeled or torn away to expose the medication in the tray cavities, but is generally aluminium foil, which has the dual advantage of being easily rupturable and vapour-impermeable. Such blister packs normally carry only one-unit dose of the same medication in each cavity.

Mixed medication blister packs have been proposed, having larger cavities for filling by a pharmacist, wherein each cavity in a multi-cavity tray can be filled with a mixture of medications. Typically, a tray may have a 2×7, 3×7, 4×7, or 5×7 array of cavities corresponding to 2, 3, 4, or 5 predefined medication times per day over a 7-day period, or one dose prescribed per day over a 2, 3, 4, or 5-week period. For example, a 4×7 tray may be filled with the medication to be taken at breakfast-time, lunchtime, early evening and immediately before retiring each day for a week, and then the filled cavities sealed with a rupturable or sequentially rupturable film or foil cover. Printed instructions on the pack identify the intended sequence of opening the individual cavities to dispense their contents according to the prescribed dosage regimen.

Disadvantages of conventional blister packs using a rupturable cover sheet are the difficulty experienced by some patients, particularly the elderly, in pushing the medication through the cover sheet, the need for expensive laminating equipment to seal the aluminium cover sheet over the cavities after the initial filling, and the difficulty experienced by the user in selecting the cavity containing the medication to be dispensed if the medication is pushed up through the foil from below. If the wrong cavity is opened by mistake, then re-sealing is impossible because the cover sheet has ruptured.

A major disadvantage of the blister pack using a peelable cover sheet is the difficulty experienced by the user in peeling or tearing away a single selected portion of the cover sheet to expose the contents of only one preselected cavity. This can be achieved by scraping a finger-nail over a corner or tab portion of a segment of the cover sheet sealing the preselected cavity but grasping that corner to peel away the complete segment sometimes requires considerable manual dexterity and possibly good eyesight, which is beyond the abilities of many elderly users. Also, if a tacky peelable adhesive is used to adhere the cover sheet to the tray, it is desirable to prevent the contents of the tray from coming into contact with the adhesive. Finally, the film cover sheet may not have as high a vapour impermeability as metal foil, so there is a reluctance on the part of pharmacists to pre-fill a mixed medication blister pack with medication for administration more than seven days in advance of the filling date, lest the medication deteriorates due to storage in humid ambient conditions.

WO 2005/023670 describes a container that aims to overcome some or all of the above problems and disadvantages. A similar container for storing and dispensing consumer products is shown in FIGS. 1 to 4 and includes a tray 1 having a generally planar top surface 2 into which has been formed an array of discrete cavities 3 for receiving the consumer products. A cover film 10 (FIG. 2) is adhered to the generally planar top surface of the tray 1 by a layer of peelable adhesive to seal the cavities 3 to retain the consumer products in the cavities. The cover film 10 has pre-formed lines of separation 13 defining a releasable portion 12 per cavity to retain the consumer products in that cavity until it is removed. The cover film 10 therefore has a corresponding array of releasable portions 12. Each line of separation 13 can be a tear line (e.g., a score line or perforation line) that must be torn or broken to release the releasable portion, or a cut line extending completely through the material of the cover film 10. Each releasable portion 12 of the cover film 10 has low vapour transmission properties in the area which in use overlies the associated cavity, those low vapour transmission properties being created by a barrier patch 24 (FIG. 3) with high vapour barrier properties shaped and sized to overlie the associated cavity. Each barrier patch 24 is adhered to the underside of the cover film 10 by the same layer of peelable adhesive as that which adheres the cover film to the top surface of the tray 1.

The array of barrier patches 24 can be created from a single sheet of barrier film 20 (FIG. 3) as follows. A single sheet of barrier film 20 is secured to the underside of the cover film 10 by a peelable adhesive to form a seal (FIG. 4). The barrier film 20 has pre-formed lines of separation 23 (e.g., tear lines such as score lines or perforation lines, or cut lines) defining the periphery of each vapour-resistant barrier patch 24 so that peeling away the majority of the barrier film 20 from the cover film 10 immediately prior to application of the cover film to secure it to the generally planar top surface of the tray 1 exposes the peelable adhesive in areas necessary for adhesion to the tray. If the lines of separation 23 are tear lines they will tear when the barrier film 20 is removed to leave a barrier patch 24 attached to the underside of each releasable portion 12 of the cover film.

In a preferred arrangement, the barrier patches 24 are larger than the associated releasable portions 12 of the cover film 10 and are adhered to an overlapping region of the cover film between the pre-formed line of separation in the cover film and the periphery of the associated barrier patch. The barrier patches 24 are not adhered to the generally planar surface of the tray 1, but only to the cover film.

The barrier film 20 can have a further pre-defined tear line 25 (or cut line) close to one edge thereof to define a tear-off strip 26 which when removed exposes a location anchorage area of the peelable adhesive on the underside of the cover film 10, for adhering an edge portion of the cover film 10 to an edge portion 4 of the tray 1 before peeling away the majority of the barrier film 20 and adhering the cover film over the cavities. To assist in the process of adhering the cover film 10 to the top surface of the tray, the tray 1 can have upstanding cover film location means 5. The cover film 10 can have cooperating means 11 for accurate location of the cover film over the tray 1 with the one or more cavities 3 and associated tear-off portions 12 in register before adhering the cover film to the tray.

The cover film 10 is secured to the tray 1 by the same layer of peelable adhesive that is used to secure the cover film to the barrier film 20. After the majority of the barrier film 20 has been peeled away from the cover film 10 to expose the peelable adhesive, the cover film can be secured to the top surface of the tray 1.

In one arrangement, each releasable portion 12*a* is attached to the remainder of the cover film 10 by a bridge region 16 defined by a gap in the associated pre-formed line of separation. (Although in FIG. 2 only one releasable portion 12*a* of this type is shown, it will be readily appreciated that in practice all of the releasable portions would include a similar bridge region if the seal has this particular "letterbox" construction). This means that the line of separation 13*a* defining each releasable portion 12*a* in the cover film does not extend completely around the periphery of the associated cavity to form a closed loop. The ends of the line of separation 13*a* are separated by the bridge region 16. The releasable portion 12*a* will remain attached to the cover film 10 by means of the bridge region 16 when it separates along the associated line of separation 13*a* to define a "flap" that overlies the cavity. This might be considered to be more environmentally friendly than if the lines of separation extend completely around the periphery of the or each cavity because the individual releasable portions do not become fully detached from the cover film and do not need to be discarded each time the contents of a cavity are dispensed.

To dispense the contents of a particular cavity, the user simply presses down on the overlying releasable portion 12*a*. If the line of separation 13*a* is a tear line (e.g., a score line or a perforation line) the application of a sufficient amount of force will cause it to tear such that the releasable portion 12*a* is released from the remainder of the cover film 10 apart from in the bridge region 16. The bridge region 16 acts as a hinge to allow the attached releasable portion 12*a* (or "flap") to bend downwardly into the cavity or upwardly to allow the contents of the cavity to be dispensed through the opening created in the cover film 10. Most of the barrier patch 24 adhered to the releasable portion will be peeled away from the overlapping region of the cover film 10 that surrounds the opening. However, a small portion of the barrier patch 24 that lies underneath the bridge region 16 may remain partially or loosely adhered to the cover film 10.

The barrier patch 24 will normally remain adhered to the underside of the releasable portion 12*a* after it has been released from the cover film 10. But a small risk has been identified that the barrier patch 24 might become detached from the releasable portion 12*a*, e.g., if it is deliberately peeled away or removed. The present invention provides a solution to address this problem.

The preferred arrangement incorporates tamper evident properties because once a releasable portion 12*a* of the cover film 10 has been released, it cannot be easily repositioned over the associated cavity. This is because the barrier patch 24 is slightly larger than the releasable portion 12*a* such that the overlapping region of the cover film 10 surrounding the opening (i.e., the part of the cover film from which the barrier patch 24 is peeled away when the releasable portion 12*a* is released from the cover film) will tend to adhere to the generally planar top surface of the tray once the peelable adhesive is exposed. This makes it very difficult to slide the peripheral edge of the barrier patch 24 back between the cover film 10 and the top surface of the tray. Tamper evident properties are especially important if the container is used to store and dispense food and medication such as pills, tablets and capsules.

SUMMARY OF THE INVENTION

The present invention provides a seal for use with a container for storing and dispensing consumer products comprising a tray having a generally planar top surface into which has been formed one or more discrete cavities for receiving the consumer products, the seal comprising:

a cover film to seal the one or more cavities to retain the consumer products in the one or more cavities when secured to the generally planar top surface of the tray, the cover film having pre-formed lines of separation defining a releasable portion per cavity; and a barrier film secured to the cover film, the barrier film having pre-formed lines of separation defining a barrier patch per releasable portion;

wherein the or each releasable portion is attached to the remainder of the cover film by a bridge region defined by a gap in the associated pre-formed line of separation; and wherein the or each barrier patch includes a main portion that is shaped and sized so that in use it overlies an associated cavity, and a securing portion that projects outwardly from the main portion and which is substantially aligned with the bridge region of the associated releasable portion.

The barrier film can be secured to the cover film by a layer of peelable adhesive.

Each barrier patch can be larger than the associated releasable portion, preferably such that in use it overlies a region of the generally planar top surface of the tray extending completely around the periphery of the associated cavity. With this arrangement, the seal can incorporate tamper evident properties as described above.

The main portion of the or each barrier patch can be adapted to be peeled away from an overlapping region of the cover film between the pre-formed line of separation in the cover film and the periphery of the barrier patch when the associated releasable portion is released.

The securing portion of the or each barrier patch can be adapted to remain secured to the cover film (e.g., by the peelable adhesive) when the associated releasable portion is released to prevent the barrier patch from becoming detached from the associated releasable portion.

The cover film can include at least two releasable portions and the barrier film can include at least two barrier patches. The securing portion of a first barrier patch can extend to the pre-formed line of separation of a second, preferably adjacent, barrier patch. The securing portion of the first barrier patch can extend to part of the pre-formed line of separation of the second barrier patch that defines the main portion of the second barrier patch. The securing portion of the first barrier patch can include a narrowed (or "neck") part. The securing portion can also extend towards an edge of the seal.

The or each pre-formed line of separation in the barrier film can be formed by a pre-scored or pre-perforated tear line, a cut line, or a combination thereof. The pre-scored tear line may be created by cutting or scoring part way through but not fully through the thickness of the barrier film. The depth of the pre-scored tear lines or the size and shape of the individual perforations of the pre-perforated tear lines can be determine to provide the right amount of resistance to separation.

The or each pre-formed line of separation in the cover film can be formed by a pre-scored or pre-perforated tear line, a cut line, or a combination thereof. The pre-scored tear line may be created by cutting or scoring part way through but not fully through the thickness of the cover film. The depth of the pre-scored tear lines or the size and shape of the individual perforations of the pre-perforated tear lines can be determine to provide the right amount of resistance to separation.

The cover film may have pre-formed lines of separation defining an array of releasable portions. The barrier film may also have pre-formed lines of separation defining an array of barrier patches, each barrier patch being associated with a releasable portion and being shaped and sized so that in use it overlies one of the cavities in the tray.

The cover film may be a metal foil, such as aluminium foil, a metallized polymeric film or paper sheet, a plastics film of single or multiple layer construction, or any combination thereof, depending on the sort of consumer products to be stored and dispensed from the container. The cover film is preferably non-rupturable (except around any pre-formed tear lines) so that the consumer products cannot be accidentally or deliberately pushed through the cover film.

The barrier film may be a metal foil, such as aluminium foil, a metallized polymeric film or paper sheet, a plastics film of single or multiple layer construction, or any combination thereof, depending on the sort of consumer products to be stored and dispensed from the container.

The present invention further provides a container for storing and dispensing consumer products, comprising:

a tray having a generally planar top surface into which has been formed one or more discrete cavities for receiving the consumer products; and a seal comprising a cover film secured to the generally planar top surface of the tray to seal the one or more cavities to retain the consumer products in the one or more cavities, the cover film having pre-formed lines of separation defining a releasable portion per cavity; and a barrier patch per releasable portion secured to the cover film;

wherein the or each releasable portion is attached to the remainder of the cover film by a bridge region defined by a gap in the associated pre-formed line of separation; and wherein the or each barrier patch includes a main portion that is shaped and sized so that it overlies an associated cavity, and a securing portion that projects outwardly from the main portion and which is substantially aligned with the bridge region of the associated releasable portion.

The cover film can be secured to the generally planar top surface of the tray by a layer of peelable adhesive. The or each barrier patch can be secured to the underside of the cover film by the same layer of peelable adhesive as that which secures the cover film to the generally planar top surface of the tray.

The or each barrier patch can be larger than the associated releasable-off portion, preferably such that it overlies a region of the generally planar top surface of the tray extending completely around the periphery of the associated cavity.

The main portion of the or each barrier patch can be adapted to be peeled away from an overlapping region of the cover film between the pre-formed line of separation in the cover film and the periphery of the barrier patch when the associated releasable portion is released.

The securing portion of the or each barrier patch can be adapted to remain secured to the cover film when the associated releasable portion is released to prevent the barrier patch from becoming detached from the associated releasable portion.

Other features of the seal can be as described herein.

The cover film prior to application to secure it to the generally planar top surface of the tray to retain the consumer products within the one or more cavities can have over the whole of its underside a barrier film secured thereto by the peelable adhesive, the barrier film having pre-formed lines of separation defining a barrier patch per releasable portion, so that peeling away the majority of the barrier film immediately prior to application of the cover film to secure it to the generally planar top surface of the tray exposes the peelable adhesive in areas necessary for adhesion to the tray but leaves the or each barrier patch attached to the underside of the cover film. The cover film can be applied to the generally planar top surface of the tray manually or by means of an automated process.

The container can be a multiple-compartment container for containing and dispensing medication according to a pre-defined dosage regimen.

When a releasable portion is released from the remainder of the cover film, e.g., by separating or tearing along the associated pre-formed line of separation, the bridge region of the releasable portion acts as a hinge to allow the releasable portion to bend downwardly into the cavity or upwardly to allow the contents of the cavity to be dispensed through the opening created in the cover film.

The securing portion of the or each barrier patch projects outwardly from the main portion and is preferably adapted to remain secured to the cover film after the associated releasable portion has been released. In practice, this is achieved because the securing portion provides an additional surface area that overlies the generally planar top surface of the tray and is secured to the underside of the cover film next to the opening, e.g., by the peelable adhesive that adheres the barrier patch to the cover film. The securing portion therefore significantly increases the amount of force that is necessary to detach or peel away the barrier patch from the releasable portion. A hinge is also provided between the securing portion of the or each barrier patch and the main portion that is secured to the underside of the associated releasable portion and is adapted to be peeled away from an overlapping region of the cover film between the pre-formed line of separation in the cover film and the periphery of the associated barrier patch when the releasable portion is released. The main portion of the or each barrier patch can bend downwardly or upwardly with the associated releasable portion to which it is secured. As defined herein, the "substantial alignment" between the securing portion of each barrier patch and the bridge region of the associated releasable portion should be interpreted broadly to the extent that the respective hinges are generally at least partially in register, partially overlapping, or are at least on the same side of the releasable portion, to ensure that the released releasable portion and the secured barrier patch can bend together as intended and to allow the contents of the underlying cavity to be dispensed through the opening created in the cover film.

The width of each bridge region, as determined by the gap in each line of separation in the cover film, can be substantially the same as the width of the securing portion of the associated barrier patch, or it can be larger or smaller. The securing portion of the or each barrier patch can also be offset relative to the main portion, e.g., not be aligned with a centre line of the main portion. In one arrangement, the or each barrier patch can have two or more securing portions that each project outwardly from the main portion and which are substantially aligned with the bridge region of the associated releasable portion.

The securing portion of the or each barrier patch can be of any suitable shape and size. If the seal or the barrier film includes at least two barrier patches, the shape and size of the respective securing portions can be the same or different. For example, a barrier patch that is located adjacent an edge of the seal might have a different securing portion to other barrier patches because of space constraints.

BRIEF DESCRIPTION OF THE DRAWINGS

The present invention can be even more fully understood with the reference to the accompanying drawings which are intended to illustrate, not limit, the present invention.

DETAILED DESCRIPTION OF THE INVENTION

Figure 1:
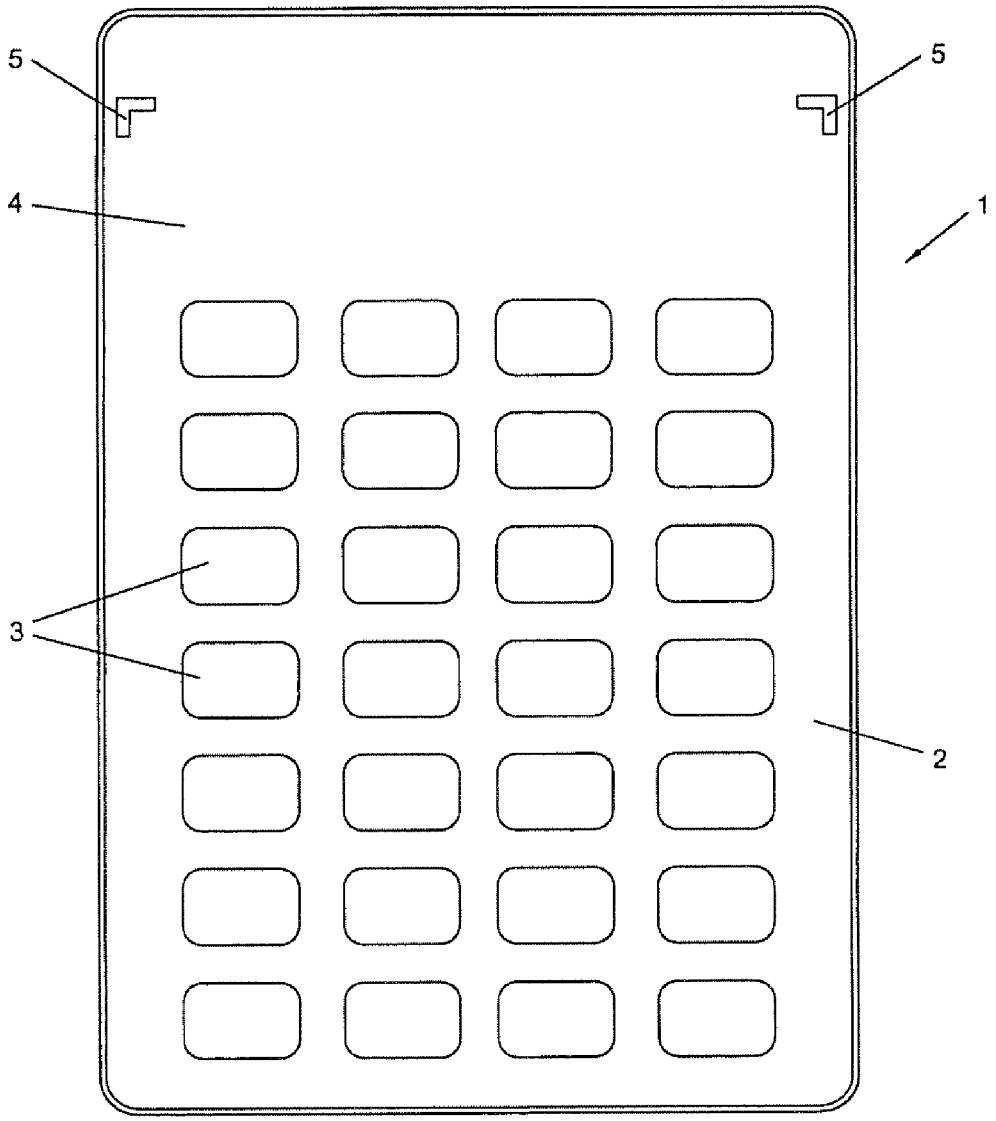
FIG. 1 is a top view of a moulded tray of a known multiple-compartment dispensing container.
Figure 2:
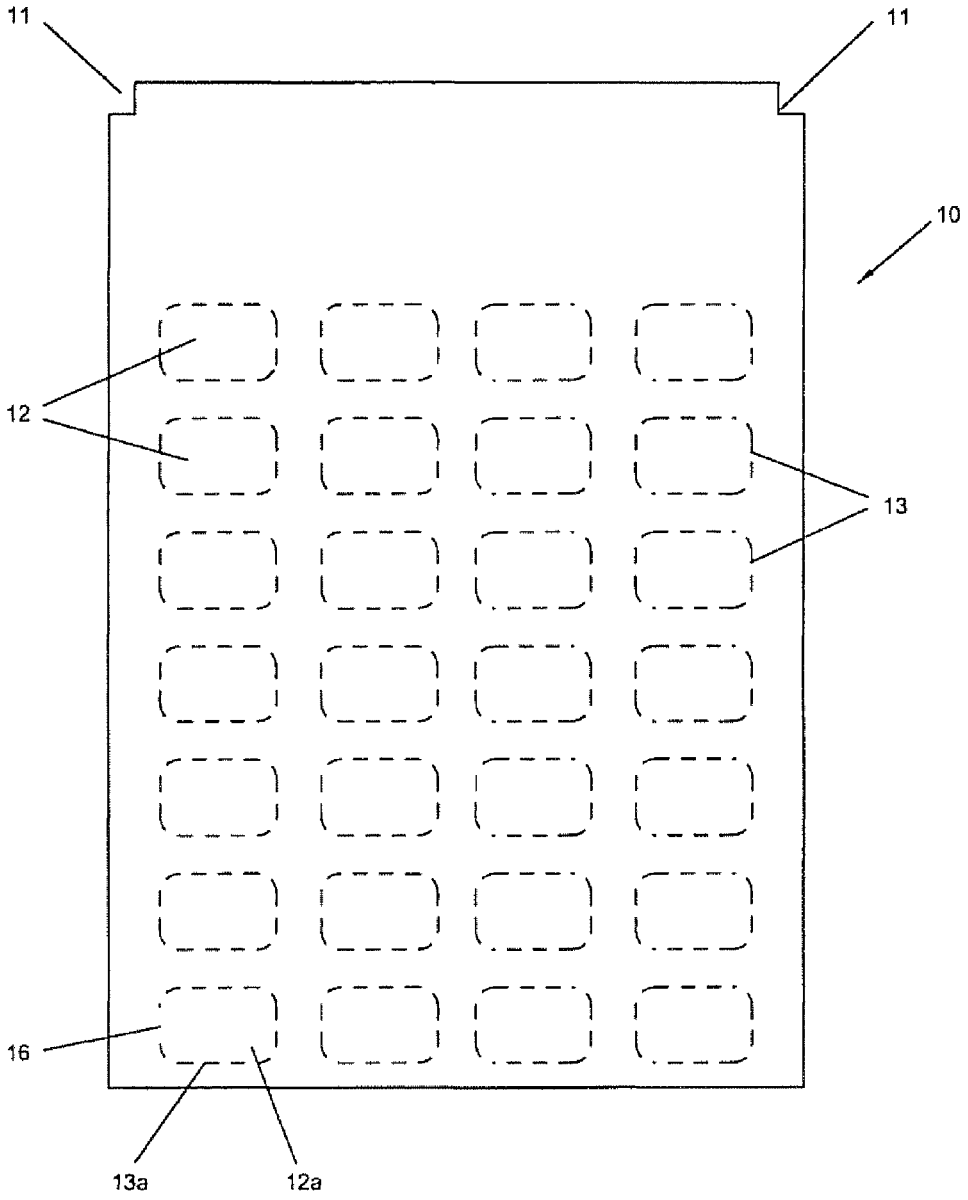
Figure 2 PRIOR ART
FIG. 2 is a top view of a known cover film.
Figure 3:
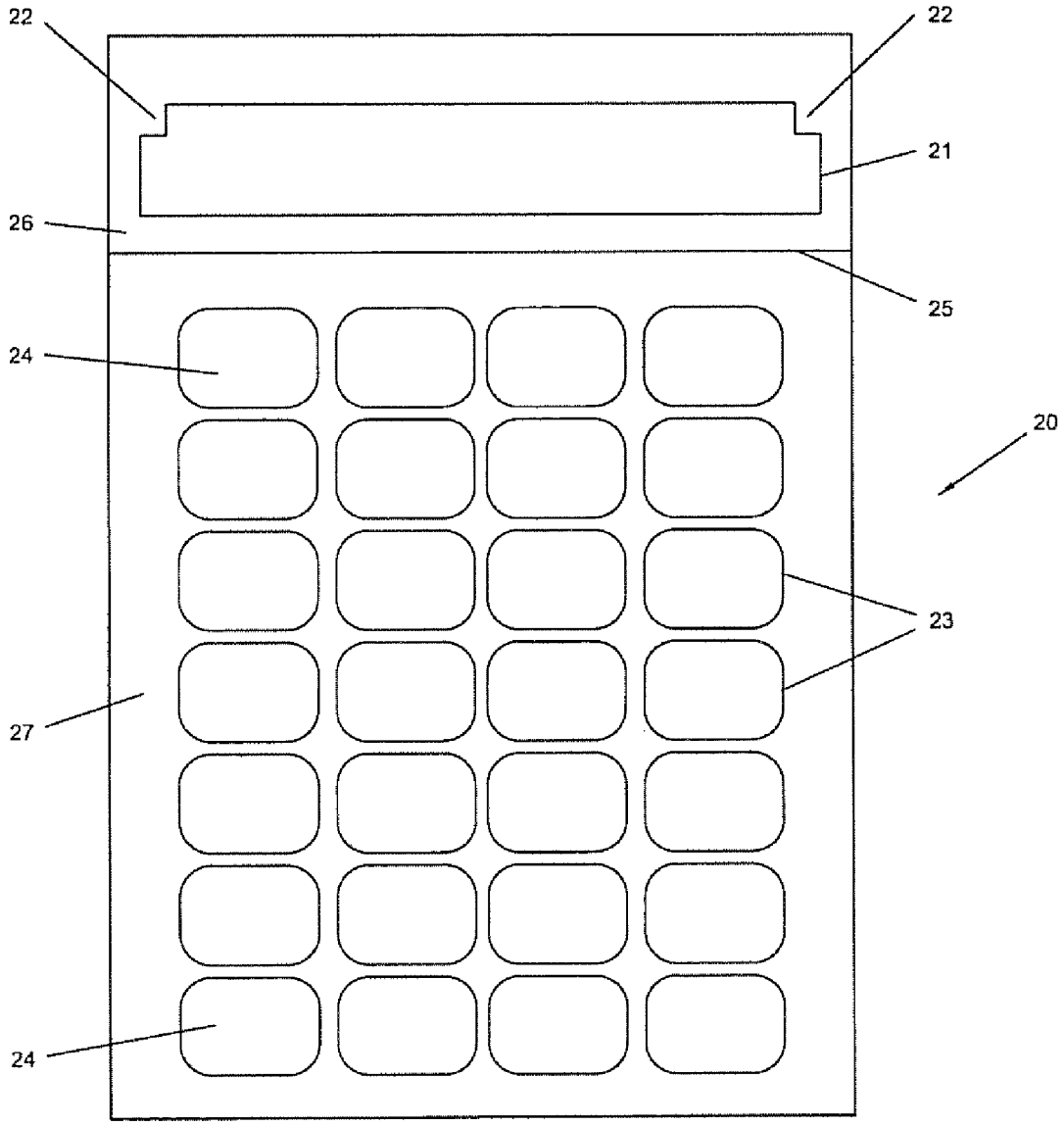
Figure 3 PRIOR ART
FIG. 3 is a top view of a known barrier film to be used in conjunction with the cover film of FIG. 2 to form a known seal.
Figure 4:
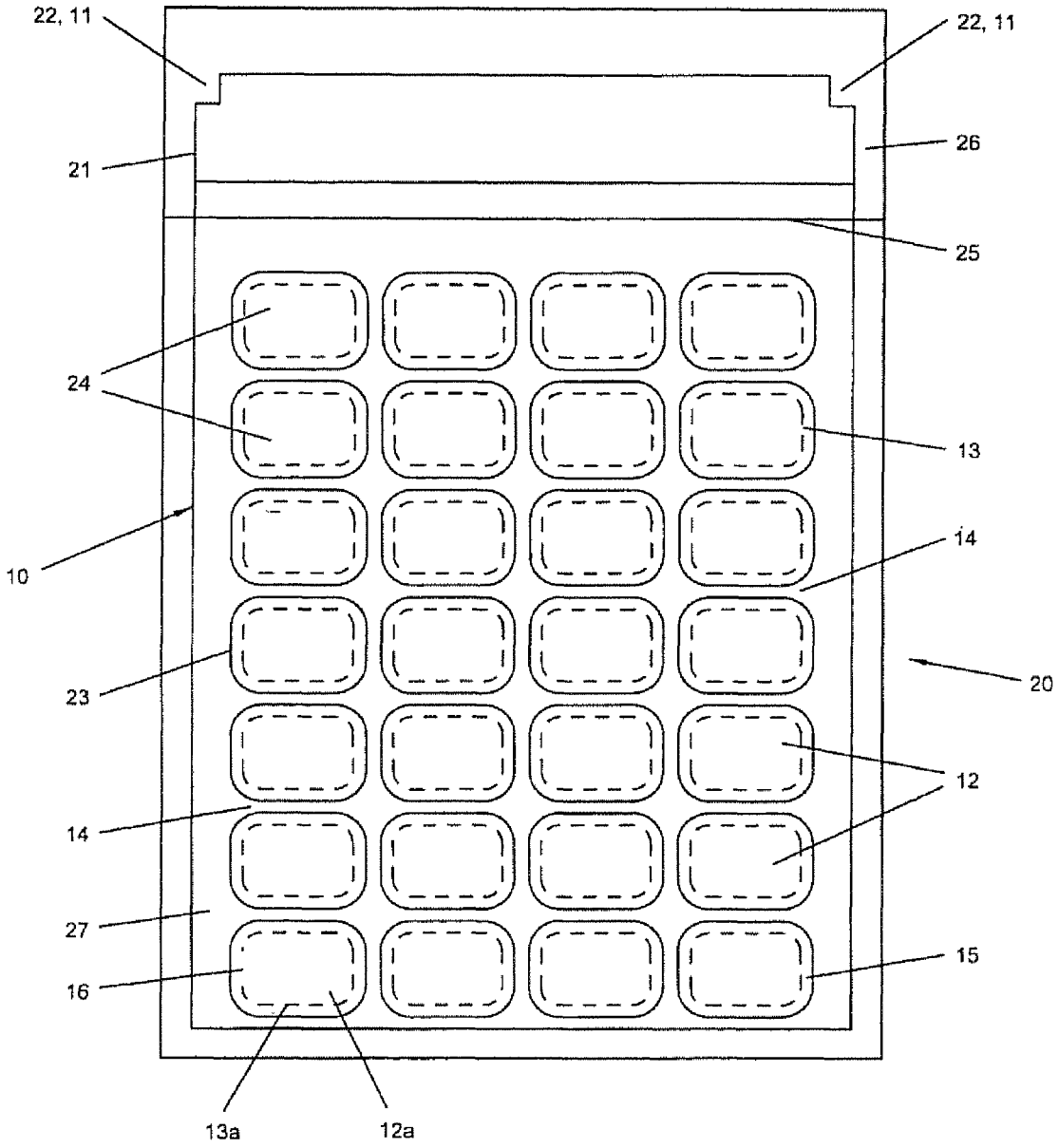
Figure 4 PRIOR ART
FIG. 4 is a top view of a known seal where the cover film of FIG. 2 has been secured to the barrier film of FIG. 3.

With reference to FIGS. 5 to 10 show part of a seal for use with a container for storing and dispensing consumer products where the barrier patches have different securing portions. Like parts have been given the same reference sign throughout.

The seal and the container are generally as described above with reference to FIGS. 1 to 4.

The container is suitable for storing and dispensing a wide range of consumer products but might be used as a multiple-compartment container for organising and storing mixed medication for subsequent dispensation according to a predefined dosage regimen. The container includes a tray 30 formed from a sheet of thermoplastic material, for example by press moulding or by vacuum moulding. The tray has a generally planar top surface 32 into which has been formed an array of discrete cavities 34 for receiving the consumer products. It will be readily appreciated that the number and arrangement of the cavities will depend on the particular dosage regimen required.

The seal 36 includes a cover film 38 and a barrier film 46 adhered together by a layer of peelable adhesive. The cover film 38 is a sheet of smooth and flexible, and preferably transparent, plastics film, the outline of which corresponds generally to the outline of the tray 30 with which it is to be used. The cover film 38 includes an array of releasable portions but only two releasable portions 40*a*, 40*b* are shown. Each of the releasable portions 40*a*, 40*b* is defined by a line of separation 42. As shown, the lines of separation 42 defining the two adjacent releasable portions 40*a*, 40*b* are pre-formed perforated tear lines that do not extend completely around the periphery of an underlying cavity to form a closed loop. The ends of each tear line are separated by a bridge region 44 so that each releasable portion 40*a*, 40*b* remains attached to the cover film 38 even when the associated tear line 42 is torn.

The entire underside of the cover film 38 is coated with a peelable adhesive. Prior to use, the cover film 38 is adhered to the barrier film 46. The barrier film 46 is a sheet of smooth and flexible, and preferably transparent, plastics film.

The barrier film 46 includes an array of barrier patches but only two barrier patches 48*a*, 48*b* are shown. Each of the barrier patches 48*a*, 48*b* is defined by a line of separation 50.

Figure 5:
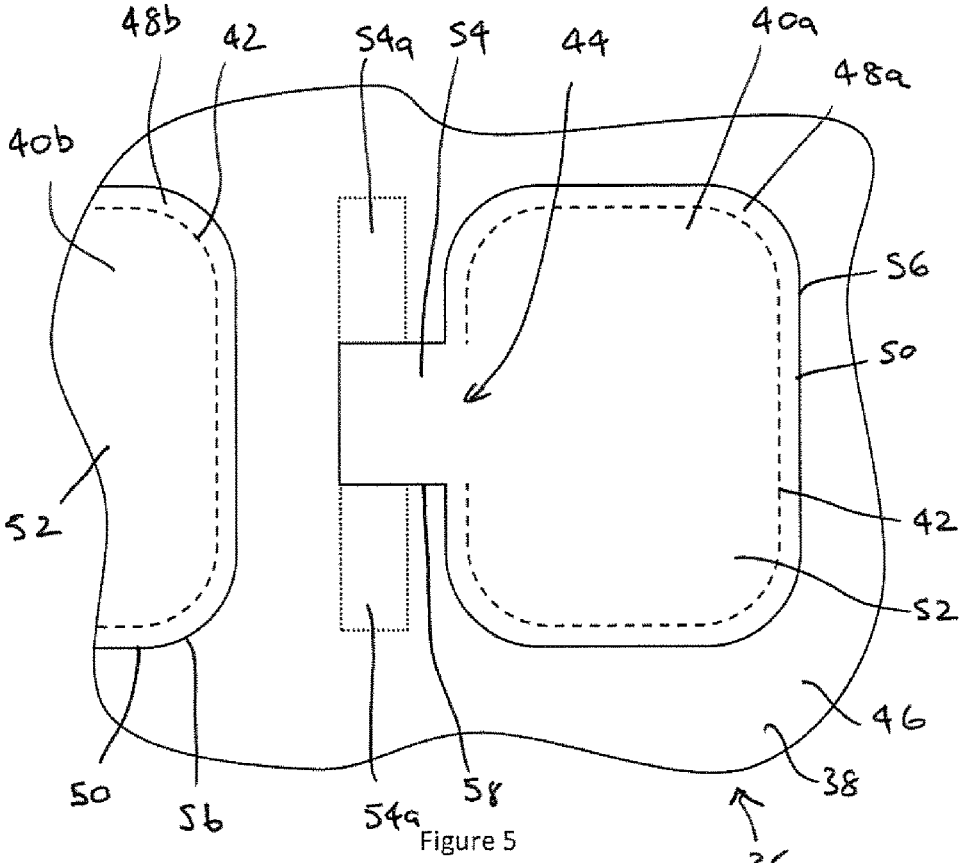
FIGS. 5 to 10 are top views of part of a seal according to the present invention.

The barrier patch 48*a* includes a main portion 52 that in use overlies a tray cavity 34 and a securing portion 54 that extends outwardly from the main portion. The securing portion 54 can have any suitable shape. In FIG. 5, the securing portion 54 is shown to be generally rectangular but it can be generally T-shaped and include one or more extensions or "wings" 54*a* (which are shown ghosted) to increase its surface area still further. The shape of the securing portion might take into account the need to remove the majority of the barrier film 46 from the cover film 38 to expose the peelable adhesive necessary to adhere the cover film to the generally planar top surface of the tray.

The main portion 52 of the barrier patch 48*a* is slightly larger than the associated releasable portion 40*a* in the cover film 38. The barrier patch 48*b* also has a main portion 52 that is slightly larger than the associated releasable portion 40*b* in the cover film 38. Although not shown, the barrier patch 48*b* can have a securing portion that is the same as the securing portion of barrier patch 48*a* or different.

In FIG. 5, the periphery of the main portion 52 of each barrier patches 48*a*, 48*b* is defined by a pre-formed cut line 56. The periphery of the securing portion 54 of barrier patch 48*a* is also defined by a pre-formed cut line 58. The securing portion 54 of barrier patch 48*a* extends part of the way towards the adjacent barrier patch 48*b*. The cut lines 56, 58 together define the line of separation 50 and hence the periphery of the barrier patch 48*a* as a whole. When the cover film 38 is adhered to the generally planar top surface 32 of the tray 30, the part of the cover film between the securing portion 54 of the barrier patch 48*a* and the adjacent barrier patch 48*b* (which part is identified by reference sign 60 in FIGS. 5 and 11) is adhered to the generally planar top surface 32 of the tray 30 and provides a physical barrier that prevents transfer of medication between the adjacent cavities 34. This can be seen most clearly in FIG. 11.

Figure 6:
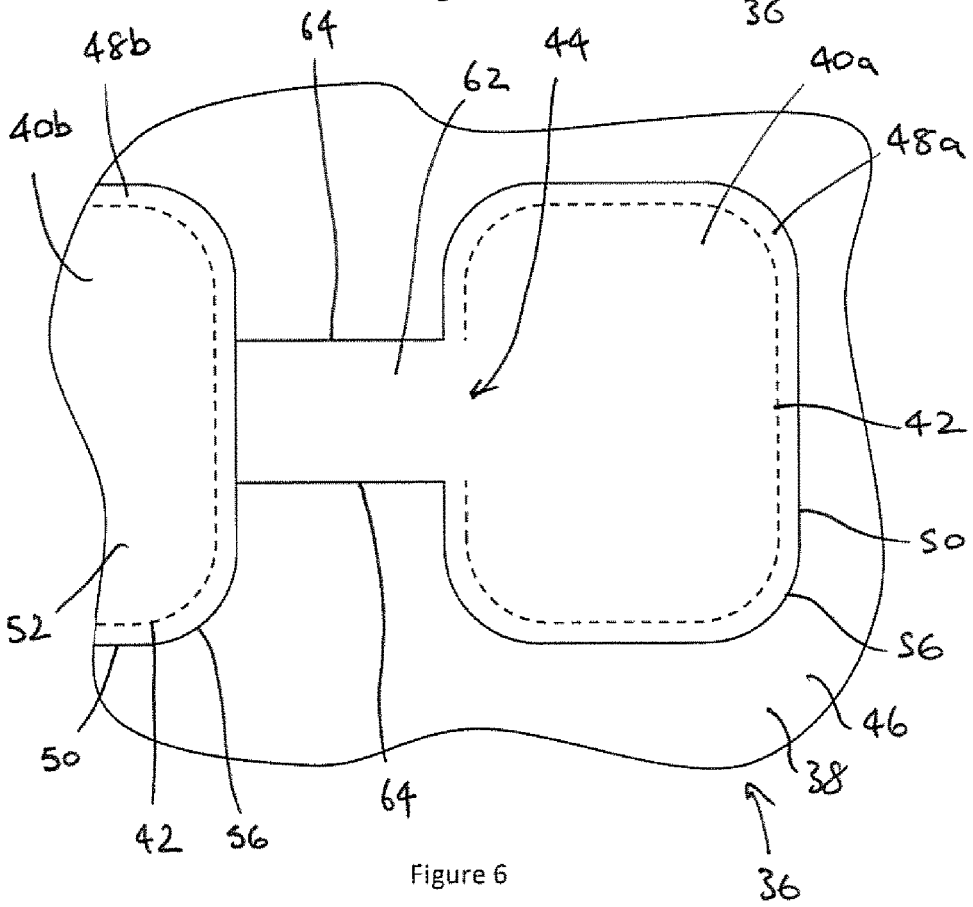
Figure 7:
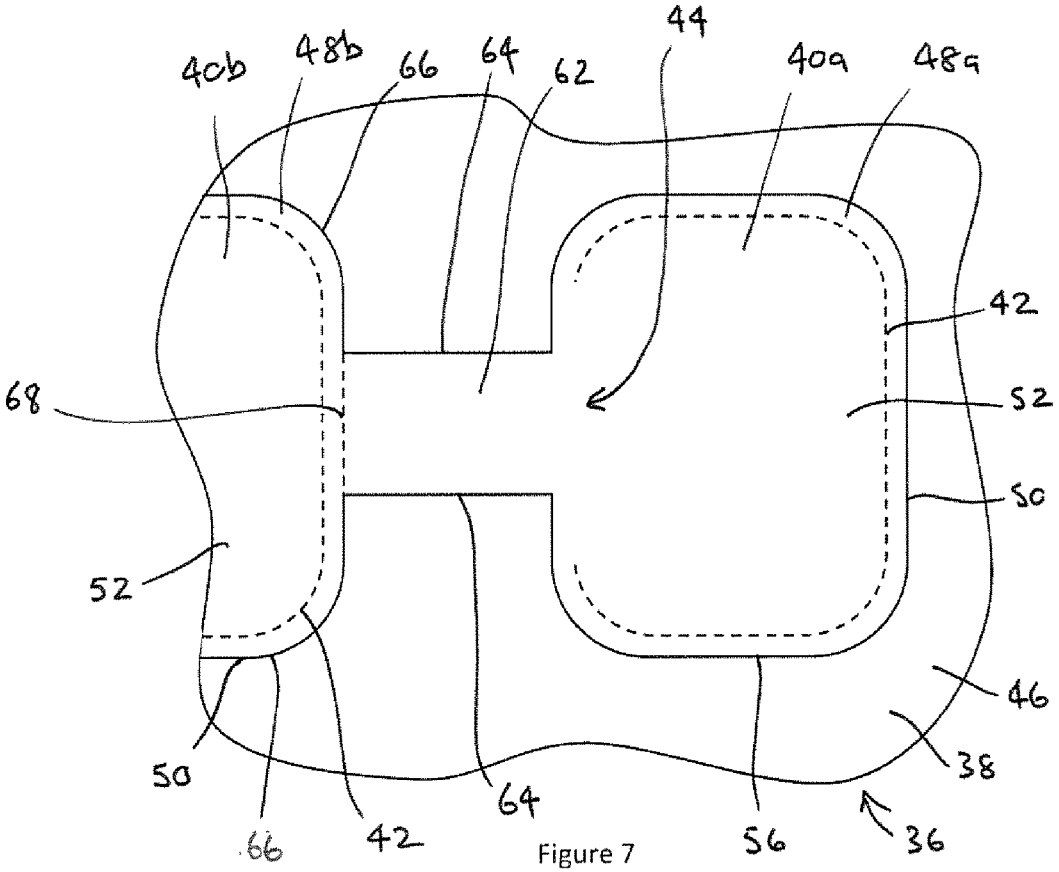

In FIG. 6, the periphery of the securing portion 62 of barrier patch 48*a* is defined partly by pre-formed cut lines 64 that extend all the way to the pre-formed cut line 56 that defines the main portion 52 of the adjacent barrier patch 48*b*. The periphery of the securing portion 62 of barrier patch 48*a* is therefore also partly defined by the pre-formed cut line 56 of the adjacent barrier patch 48*b*. A variation is shown in FIG. 7 where the main portion 52 of the adjacent barrier patch 48*b* is defined by the combination of a pre-formed cut line 66 and a pre-perforated tear line 68. The periphery of the securing portion 62 of barrier patch 48*a* is partly defined by the pre-formed cut lines 64 and partly defined by the pre-perforated tear line 68. The same general construction can be used with the variations described below with reference to FIGS. 8 to 10. The pre-perforated tear line 68 can be considered to be a cut line but with one or more "ties" that are defined by small gaps in the cut line.

When the adjacent releasable portion 40*b* is released from the cover film 38 along the line of separation 42, the pre-perforated tear line 68 will be torn to release the adjacent barrier patch 48*b* from the securing portion 62 of barrier patch 48*a* and allow it to be peeled away from the cover film. In FIG. 7, the main portion 52 of barrier patch 48*a* is defined by a pre-formed cut line 56. But the main portion 52 of barrier patch 48*a* might be defined by the combination of a pre-formed cut line and a pre-perforated tear line if the securing portion of a further adjacent barrier patch (not shown) extends to it.

FIG. 7 also shows that the bridge region 44 that is defined by the gap in the pre-perforated tear line 42 can be significantly larger than the width of the securing portion 62 of the barrier patch 48*a*. In FIGS. 5 and 6, the bridge region 44 is substantially the same width as the securing portion. Although not shown, the bridge region can also be narrower than the width of the securing portion.

Figure 8:
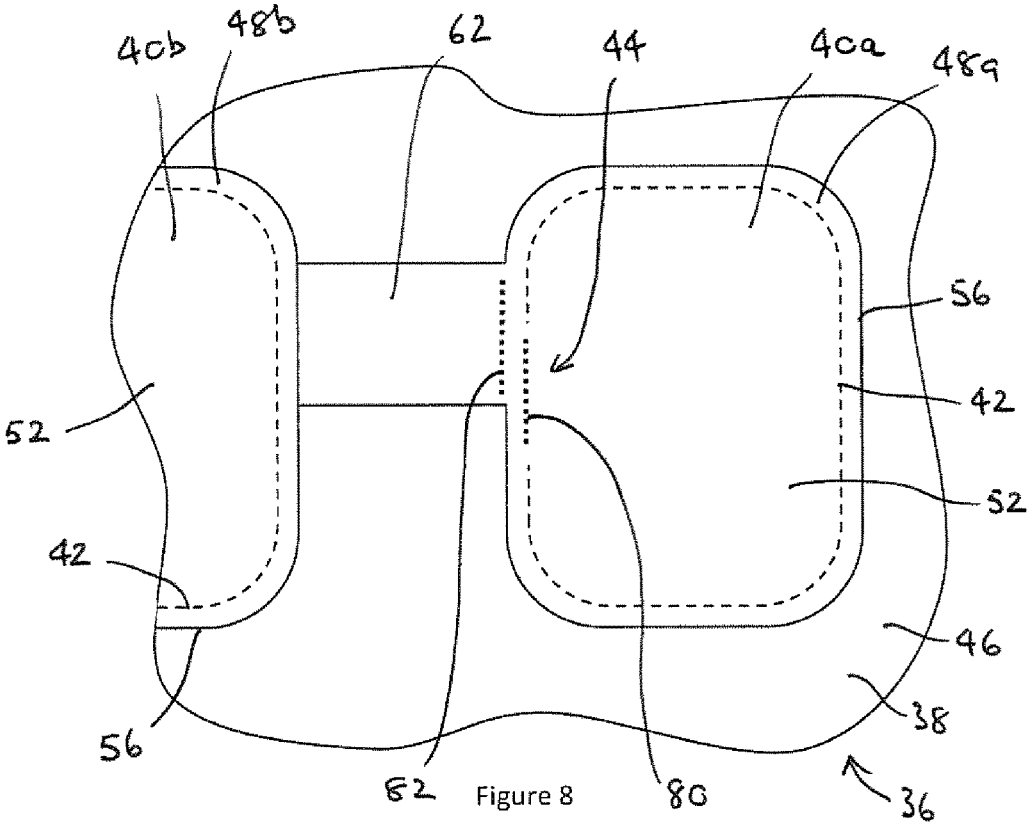

FIG. 8 shows that the securing portion 62 can be offset relative to the bridge region 44 such that the hinge 80 defined by the bridge region 44 and the hinge 82 between the securing portion 54 and the main portion 52 of barrier patch 48*a* are partially overlapping.

Figure 9:
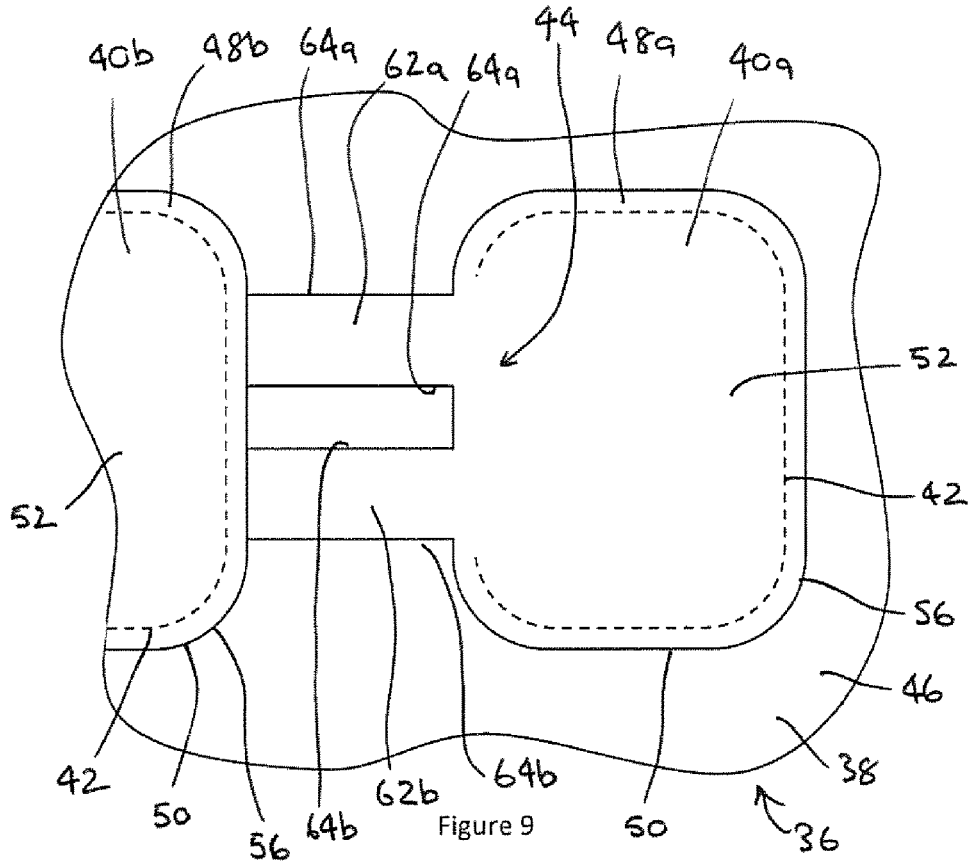

A further variation is shown in FIG. 9 where barrier patch 48*a* has two securing portions 62*a*, 64*b*, each being defined partly by pre-formed cut lines 64*a*, 64*b* that extend all the way to the pre-formed cut line 56 that defines the main portion 52 of the adjacent barrier patch 48*b*.

Figure 10:
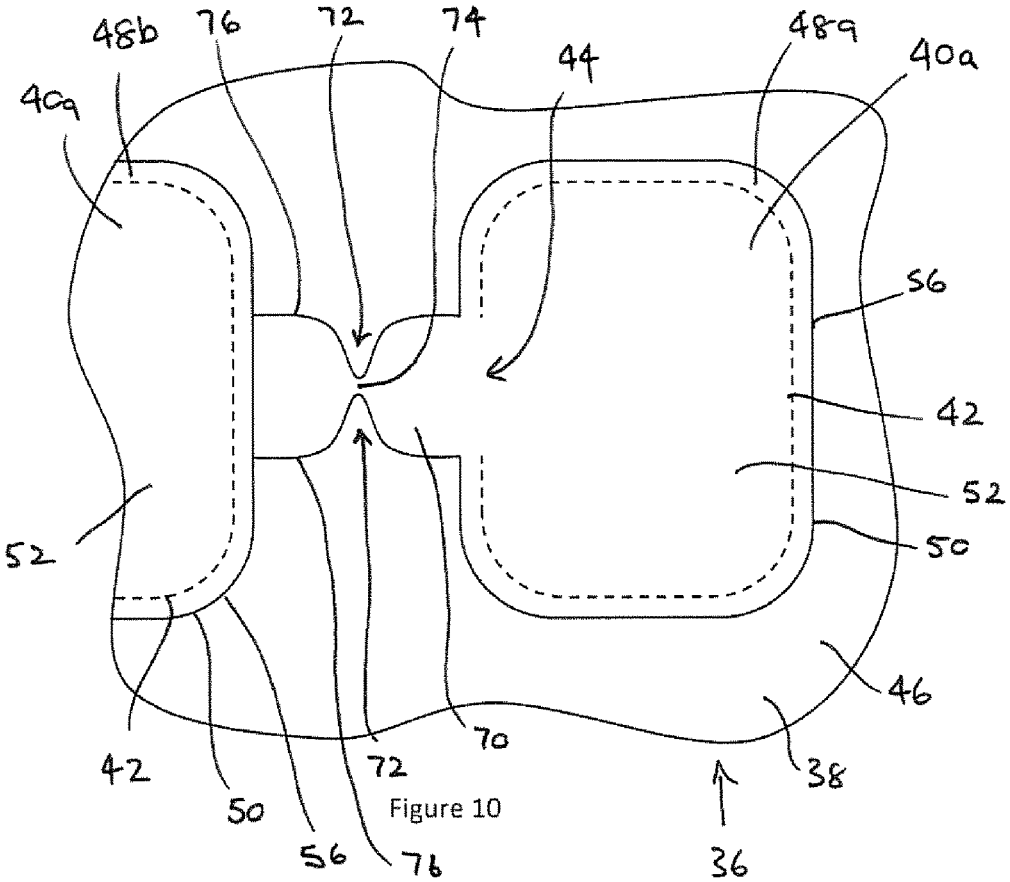

A further variation is shown in FIG. 10 where the securing portion 70 of barrier patch 48*a* includes two opposing notches 72 to create a narrowed part 74 (or "neck") which forms a physical barrier that prevents transfer of medication between adjacent cavities. The periphery of the securing portion 70 of barrier patch 48*a* is partly defined by the pre-formed cut lines 76 that are shaped to form the opposing notches 72 and extend all the way to the pre-formed cut line 56 that defines the main portion 52 of the adjacent barrier patch 48*b*.

Figure 11:
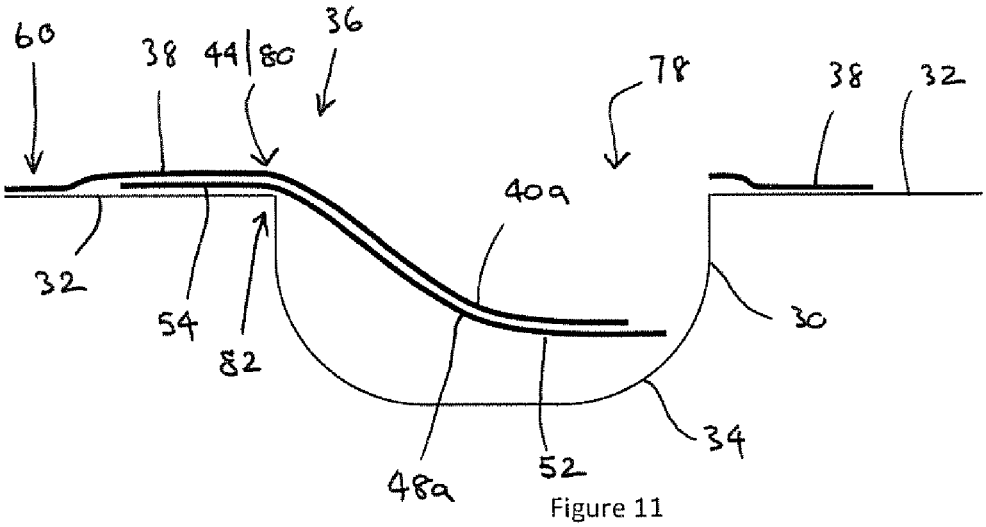
FIG. 11 is a cross section view through the seal of FIG. 5 after it has been applied to a tray.

FIG. 11 shows part of the seal of FIG. 5 after the majority of the barrier film 46 has been peeled away from the cover film 38 to leave the barrier patches adhered to the underside of the cover film. The cover film 38 has then been adhered to the generally planar top surface 32 of the tray 30 using the exposed peelable adhesive. In FIG. 11 the releasable portion 40*a* has been released from the remainder of the cover film 38, e.g., by pushing down on the releasable portion to tear along the pre-formed tear line 42. The releasable portion 40*a* has barrier patch 48*a* adhered to its underside. The periphery of the main portion 52 of barrier patch 48*a* has been peeled away from an overlapping region of the cover film 38 between the pre-formed line of separation in the cover film and the periphery of the associated barrier patch. The overlapping region of the cover film 38 is shown raised but in practice it will adhere to the generally planar top surface 32 of the tray as soon as the interposing periphery of the barrier patch 48*a* is peeled away from it. This provides tamper evident properties because the periphery of the barrier patch 48*a* cannot be reinserted between the cover film 38 and the top surface 32 of the tray 30.

It can be seen that the bridge region 44 of the releasable portion 40*a* acts as a hinge 80 to allow the releasable portion to bend downwardly into the cavity (or upwardly) to allow the contents of the cavity 34 to be dispensed through the opening 78 created in the cover film.

The securing portion 54 of the barrier patch 48*a* provides a large surface area that remains secured to the underside of the cover film 38 by the layer of peelable adhesive. A hinge 82 is also provided between the securing portion 54 of the barrier patch 48*a* and the main portion 52 that is secured to the underside of the associated releasable portion 40*a*. The securing portion 54 prevents the barrier patch 48*a* from becoming detached from the associated releasable portion 40*a* in use.

The present invention can include any combination of these various features or embodiments above and/or below as set-forth in sentences and/or paragraphs. Any combination of disclosed features herein is considered part of the present invention and no limitation is intended with respect to combinable features.

The entire contents of all references cited in this disclosure are incorporated herein in their entireties, by reference. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether such ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A tamper-evident seal for use with a tray having a generally planar top surface into which has been formed a plurality of discrete cavities for receiving the consumer products, the seal comprising:

a cover film having an underside and pre-formed lines of separation defining a plurality of releasable portions;

a layer of peelable adhesive coated on the underside of the cover film; and a barrier film comprising a plurality of barrier patches including a barrier patch per releasable portion, the barrier film being secured to the cover film by the layer of peelable adhesive;

wherein each releasable portion is attached to the remainder of the cover film by a bridge region defined by a gap in the associated pre-formed line of separation;

each barrier patch includes a main portion having a periphery, and a securing portion that projects outwardly from the main portion and that is substantially aligned with the bridge region of the associated releasable portion;

the main portion of each barrier patch is larger than the associated releasable portion of the cover film; and the periphery of the main portion of each barrier patch is adapted to be peeled away from an overlapping region of the cover film surrounding the associated releasable portion, exposing the peelable adhesive on the underside of the cover film.

2. The tamper-evident seal of claim 1, wherein the securing portion of each barrier patch is adapted to remain secured to the cover film when the associated releasable portion is released.

3. The tamper-evident seal of claim 1, wherein the plurality of barrier patches includes a first barrier patch and a second barrier patch, and wherein the securing portion of the first barrier patch extends to an edge of the second barrier patch.

4. The tamper-evident seal of claim 3, wherein the securing portion of the first barrier patch extends to part of the edge of the second barrier patch that defines the main portion of the second barrier patch.

5. The tamper-evident seal of claim 3, wherein the securing portion of the first barrier patch includes a narrowed part.

6. The tamper-evident seal of claim 1, wherein each pre-formed line of separation in the cover film is formed by a pre-scored or pre-perforated tear line, a cut line, or a combination thereof.

7. The tamper-evident seal of claim 1, wherein the barrier film further comprises pre-formed lines of separation defining each barrier patch and a peelable majority configured to be peeled away from the cover film to expose a peelable adhesive to secure the cover film to a generally planar top surface of a tray and leave each barrier patch attached to the underside of the cover film.

8. The tamper-evident seal of claim 7, wherein the peelable majority of the barrier film has been peeled away from and is separated from each barrier patch and the underside of the cover film such that the peelable adhesive is exposed in areas surrounding each barrier patch of the plurality of barrier patches, the plurality of barrier patches remain secured to the cover film, and the seal is configured to be applied to a tray having a plurality of discrete cavities.

9. A container for storing and dispensing consumer products, comprising:

a tray having a generally planar top surface into which has been formed a plurality of discrete cavities for receiving consumer products; and the tamper-evident seal of claim 1, wherein the cover film is secured to the generally planar top surface of the tray and seals the plurality of discrete cavities to retain consumer products in the plurality of discrete cavities, wherein the main portion of each barrier patch overlies an associated cavity of the plurality of discrete cavities.

10. The container of claim 9, wherein the cover film is secured to the generally planar top surface of the tray by a layer of peelable adhesive.

11. The container of claim 10, wherein each barrier patch is secured to the underside of the cover film by the same layer of peelable adhesive as that which secures the cover film to the generally planar top surface of the tray.

12. The container of claim 10, wherein each barrier patch is larger than the associated releasable portion.

13. The container of claim 12, wherein the main portion of each barrier patch is adapted to be peeled away from an overlapping region of the cover film between the pre-formed line of separation in the cover film and a periphery of the barrier patch when the associated releasable portion is released.

14. The container of claim 13, wherein the securing portion of each barrier patch is adapted to remain secured to the cover film when the associated releasable portion is released.

15. The container of claim 9, wherein the plurality of barrier patches includes a first barrier patch and a second barrier patch, and wherein the securing portion of the first barrier patch extends to an edge of the second barrier patch.

16. The container of claim 15, wherein the securing portion of the first barrier patch extends to the edge of the second barrier patch that defines part of the main portion of the second barrier patch.

17. The container of claim 15, wherein the securing portion of the first barrier patch includes a narrowed part.

18. The container according to claim 9, wherein the cover film, prior to application of the tamper-evident seal to secure it to the generally planar top surface of the tray to retain consumer products within the plurality of discrete cavities, has, over the whole of its underside, the barrier film secured thereto by the peelable adhesive, the barrier film having pre-formed lines of separation defining a barrier patch per releasable portion, so that peeling away the majority of the barrier film immediately prior to application of the cover film to secure it to the generally planar top surface of the tray, exposes the peelable adhesive in areas necessary for adhesion to the tray but leaves each barrier patch attached to the underside of the cover film.

19. The container of claim 9, wherein the barrier film further comprises a peelable majority that has been peeled away from the cover film to expose the peelable adhesive that secures the cover film to the generally planar top surface of the tray, and that leaves each barrier patch attached to the underside of the cover film, and wherein the peelable majority is separated from each barrier patch and the underside of the cover film.

* * * * *